US009740133B2

(12) United States Patent
Yamauchi et al.

(10) Patent No.: US 9,740,133 B2
(45) Date of Patent: Aug. 22, 2017

(54) CHARGING MEMBER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Kenichi Yamauchi, Mishima (JP); Kazuhiro Yamauchi, Suntou-gun (JP); Satoru Nishioka, Suntou-gun (JP); Hiroki Masu, Tokyo (JP); Noriko Suzumura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/266,315

(22) Filed: Sep. 15, 2016

(65) Prior Publication Data

US 2017/0090329 A1 Mar. 30, 2017

(30) Foreign Application Priority Data

Sep. 30, 2015 (JP) ..... 2015-193134

(51) Int. Cl.
*G03G 15/02* (2006.01)

(52) U.S. Cl.
CPC ..... *G03G 15/0233* (2013.01)

(58) Field of Classification Search
CPC ..... G03G 13/025; G03G 15/0233; G03G 15/0208; G03G 15/0216; G03G 15/162; G03G 15/1685; G03G 15/0806; G03G 15/0818; G03G 2215/021; G03G 2215/1614; G03G 2215/1619;
(Continued)

(56) References Cited

U.S. PATENT DOCUMENTS 6,190,295 B1 * 2/2001 Kawano ..... G03G 15/0233 399/176
7,907,878 B2 * 3/2011 Takagi ..... G03G 15/0818 399/286
(Continued)

FOREIGN PATENT DOCUMENTS

JP 2007256335 A * 10/2007
JP 2008-083404 4/2008
(Continued)

*Primary Examiner* — Robert Beatty
(74) *Attorney, Agent, or Firm* — Fitzpatrick Cella Harper and Scinto

(57) ABSTRACT

An electrophotographic charging member in which the adhesion of contamination is more suppressed is provided. The electrophotographic charging member includes an electro-conductive support and an electro-conductive elastic layer on the electro-conductive support, the electro-conductive elastic layer includes 10% by mass or more and 50% by mass or less of an aggregate of crosslinked rubber particles, the aggregate of the crosslinked rubber particles has a circle-equivalent diameter of 10 μm or more and 50 μm or less, the crosslinked rubber particles have one of an acrylic resin and a styrene acrylic resin chemically bonded to a surface thereof, the charging member has a protrusion derived from the aggregate of the crosslinked rubber particles on a surface thereof, and the protrusion has an average height of 50 nm or more and 200 nm or less.

7 Claims, 3 Drawing Sheets

(58) Field of Classification Search
CPC ... G03G 2215/1623; G03G 2215/1628; G03G 2215/0861
USPC ..... 399/174, 176, 265, 279, 286, 313; 430/35; 492/17, 18, 53, 54, 55, 56, 58, 492/59
See application file for complete search history.

(56) References Cited

U.S. PATENT DOCUMENTS

| | | | | |
|---|---|---|---|---|
| 7,917,064 | B2 | 3/2011 | Nagamori et al. | |
| 7,947,339 | B2 | 5/2011 | Yamauchi et al. | |
| 8,000,633 | B2 | 8/2011 | Kato et al. | |
| 8,298,670 | B2 | 10/2012 | Muranaka et al. | |
| 8,449,975 | B2 | 5/2013 | Hirakoso et al. | |
| 8,503,911 | B2 | 8/2013 | Suzumura et al. | |
| 8,526,857 | B2 | 9/2013 | Tomomizu et al. | |
| 8,628,854 | B2 | 1/2014 | Yamauchi et al. | |
| 8,715,830 | B2 | 5/2014 | Yamada et al. | |
| 8,771,818 | B2 | 7/2014 | Nishioka et al. | |
| 8,781,369 | B2 * | 7/2014 | Furukawa | G03G 15/0233 29/895.32 |
| 8,852,743 | B2 | 10/2014 | Kikuchi et al. | |
| 9,023,465 | B2 | 5/2015 | Yamada et al. | |
| 9,086,643 | B2 | 7/2015 | Kikuchi et al. | |
| 9,128,403 | B2 | 9/2015 | Yamauchi et al. | |
| 9,146,482 | B2 | 9/2015 | Watanabe et al. | |
| 9,268,243 | B2 | 2/2016 | Aoyama et al. | |
| 9,360,789 | B1 | 6/2016 | Masu et al. | |
| 9,442,408 | B2 | 9/2016 | Yamauchi et al. | |
| 9,442,451 | B2 | 9/2016 | Yamauchi et al. | |
| 2004/0197115 | A1 * | 10/2004 | Abe | G03G 15/0233 399/176 |
| 2006/0226572 | A1 | 10/2006 | Tanaka et al. | |
| 2012/0308261 | A1 | 12/2012 | Tsuru et al. | |
| 2013/0004206 | A1 | 1/2013 | Kuroda et al. | |
| 2013/0034369 | A1 | 2/2013 | Masu et al. | |
| 2013/0064571 | A1 | 3/2013 | Kodama et al. | |
| 2013/0281276 | A1 | 10/2013 | Watanabe et al. | |
| 2014/0004258 | A1 | 1/2014 | Suzumura et al. | |
| 2014/0072343 | A1 | 3/2014 | Masu et al. | |
| 2014/0080691 | A1 | 3/2014 | Kurachi et al. | |
| 2014/0221184 | A1 | 8/2014 | Arimura et al. | |
| 2014/0287899 | A1 | 9/2014 | Nishioka et al. | |
| 2015/0093151 | A1 | 4/2015 | Muranaka et al. | |
| 2015/0198900 | A1 | 7/2015 | Yamada et al. | |
| 2015/0198904 | A1 | 7/2015 | Kikuchi et al. | |
| 2015/0198905 | A1 | 7/2015 | Kikuchi et al. | |
| 2015/0198906 | A1 | 7/2015 | Yamauchi et al. | |
| 2015/0198907 | A1 | 7/2015 | Hino et al. | |
| 2015/0331339 | A1 | 11/2015 | Yamada et al. | |
| 2015/0331340 | A1 | 11/2015 | Nishioka et al. | |
| 2015/0331341 | A1 | 11/2015 | Yamaguchi et al. | |
| 2015/0331342 | A1 | 11/2015 | Yamaguchi et al. | |
| 2015/0331343 | A1 | 11/2015 | Yamada et al. | |
| 2015/0331346 | A1 | 11/2015 | Yamauchi et al. | |
| 2015/0331347 | A1 | 11/2015 | Arimura et al. | |
| 2015/0331348 | A1 | 11/2015 | Doi et al. | |
| 2016/0054674 | A1 | 2/2016 | Muranaka et al. | |
| 2016/0154323 | A1 | 6/2016 | Nishioka et al. | |
| 2016/0161877 | A1 | 6/2016 | Masu et al. | |
| 2016/0187801 | A1 | 6/2016 | Yamada et al. | |
| 2016/0187809 | A1 | 6/2016 | Yamaguchi et al. | |
| 2016/0299450 | A1 | 10/2016 | Takeno et al. | |

FOREIGN PATENT DOCUMENTS

| | | | |
|---|---|---|---|
| JP | 2008248149 | A * | 10/2008 |
| JP | 2010152126 | A * | 7/2010 |
| JP | 2010248480 | A * | 11/2010 |
| JP | 5455336 | | 3/2014 |
| JP | 2015045788 | A * | 3/2015 |

* cited by examiner

CHARGING MEMBER, PROCESS CARTRIDGE AND ELECTROPHOTOGRAPHIC IMAGE FORMING APPARATUS

BACKGROUND OF THE INVENTION

Field of the Invention

The present invention relates to a charging member, a process cartridge and an electrophotographic image forming apparatus.

Description of the Related Art

In an electrophotographic image forming apparatus adopting a contact charging method in which an electrophotographic photosensitive member (hereinafter also referred to as a "photosensitive member") is charged by a charging member disposed in contact with the electrophotographic photosensitive member, toner remaining on the photosensitive member (hereinafter also referred to as "transfer residual toner") may adhere to the surface of the charging member even after toner on the photosensitive member is transferred to a paper or an intermediate transfer member.

In addition, from the viewpoint of simplifying an electrophotographic image forming apparatus and eliminating waste, a toner recycle system (hereinafter referred to as a "cleanerless system") is proposed. In the system, a cleaning apparatus for removing transfer residual toner from a photosensitive member is not provided, and transfer residual toner on the photosensitive member is recovered by a developing apparatus.

When the contact charging method is adopted in the cleanerless system, a larger amount of transfer residual toner adheres to the surface of the charging member.

As a means for reducing the adhesion of contamination substances such as an external additive and toner, Japanese Patent No. 5455336 and Japanese Patent Application Laid-Open No. 2008-83404 disclose a charging member in which a fine particle is contained in a surface layer to control surface roughness and reduce adhesion.

One aspect of the present invention is directed to providing an electrophotographic charging member in which the adhesion of contamination such as transfer residual toner is more suppressed. In addition, another aspect of the present invention is directed to providing an electrophotographic image forming apparatus and a process cartridge which can stably form high quality electrophotographic images over a long period.

SUMMARY OF THE INVENTION

According to one aspect of the present invention, there is provided a charging member including an electro-conductive support and an electro-conductive elastic layer on the electro-conductive support, wherein the electro-conductive elastic layer includes 10% by mass or more and 50% by mass or less of an aggregate of crosslinked rubber particles, the aggregate of the crosslinked rubber particles has a circle-equivalent diameter of 10 μm or more and 50 μm or less, the crosslinked rubber particles have one of an acrylic resin and a styrene acrylic resin chemically bonded to a surface thereof, the charging member has a protrusion derived from the aggregate of the crosslinked rubber particles on a surface thereof, and the protrusion has an average height of 50 nm or more and 200 nm or less.

In addition, according to another aspect of the present invention, there is provided an electrophotographic image forming apparatus including an electrophotographic photosensitive member and the charging member disposed in contact with the electrophotographic photosensitive member.

Further, according to another aspect of the present invention, there is provided a process cartridge configured to be attachable to and detachable from a main body of an electrophotographic image forming apparatus, including an electrophotographic photosensitive member and the charging member disposed in contact with the electrophotographic photosensitive member.

Further features of the present invention will become apparent from the following description of exemplary embodiments with reference to the attached drawings.

DESCRIPTION OF THE EMBODIMENTS

Figure 1:
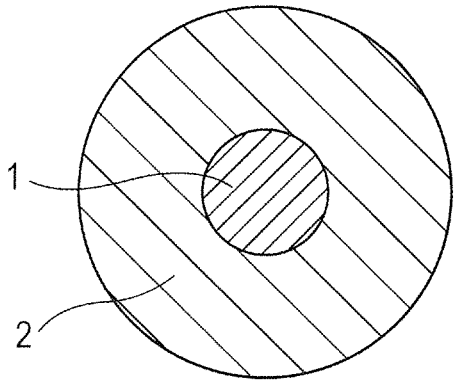
FIG. 1 is a schematic cross-sectional view of one example of a charging member according to the present invention.

Preferred embodiments of the present invention will now be described in detail in accordance with the accompanying drawings.

The present invention will be described in detail below by a roller-shaped charging member (hereinafter also referred to as a "charging roller") as one example of a charging member according to the present invention, but the present invention is not limited to the roller-shaped charging member.

The present inventors have confirmed that the charging members according to Japanese Patent No. 5455336 and Japanese Patent Application Laid-Open No. 2008-83404 achieve the effect of suppressing the adhesion of toner and the like to the surface of the charging member. However, the present inventors have recognized that in view of the adoption of the above-described cleanerless system, further technical development is necessary regarding the suppression of the adhesion of toner to the surface of a charging member. Then, the present inventors have found that one of the main causes of contamination on the surface of a charging member in an electrophotographic image forming apparatus adopting the cleanerless system is due to toner positively charged.

As a result of further study based on the above analysis, the present inventors have found that a charging member satisfying the following <Condition 1> and <Condition 2> is effective in the prevention or suppression of the adhesion of contamination due to toner positively charged.

<Condition 1>

A electro-conductive elastic layer includes an aggregate of crosslinked rubber particles having a circle-equivalent diameter of 10 μm or more and 50 μm or less, and a charging member has a protrusion derived from the aggregate of the crosslinked rubber particles on the surface thereof, and the average height of the protrusion is 50 nm or more and 200 nm or less.

<Condition 2>

The crosslinked rubber particles have one of an acrylic resin and a styrene acrylic resin chemically bonded to the surface thereof.

The present inventors presume that the reason why the effect of preventing or suppressing the adhesion of transfer residual toner is obtained in a charging member satisfying the above <Condition 1> is as follows: Due to the presence of the protrusion having an average height of nm to 200 nm derived from the aggregate of the crosslinked rubber particles, on the surface of the charging member, the contact area between transfer residual toner and the electro-conductive elastic layer reduces, and thus the transfer residual toner is more likely to roll on the surface of the charging member. As a result, the transfer residual toner is likely to be charged negativity due to friction with the surface of the charging member and is less likely to adhere to the surface of the charging member. Further, it is considered that the protrusion is derived from the aggregate of the rubber particle, and therefore contamination is likely to enter the gap between the rubber particles of the rubber particle aggregate. Therefore, it is considered that contamination does not deposit on the surface of the rubber particle aggregate constituting the protrusion, and the height of the protrusion is less likely to change even in use for a long period, and the rolling properties of toner is maintained over a long period.

In addition, by satisfying the above <Condition 2>, the adhesion of contamination substances is prevented or suppressed even when the charging member is used in an electrophotographic image forming apparatus with high speed, high endurance and small particle diameter toner using a cleanerless system.

It is considered that the mechanism for achieving the above effect by the above <Condition 2> is as follows: One of an acrylic resin and a styrene acrylic resin is chemically bonded to the surface of the crosslinked rubber particles, and thus the tackiness of the surface decreases, and thus the rolling properties of transfer residual toner in a nip with a photosensitive member become better. Further, these resins are chemically bonded to the surface, and thus the abrasion of the crosslinked rubber particles constituting the protrusion is suppressed even by image formation for a long period.

A charging member according to one aspect of the present invention will be described in detail below by taking a charging member having a roller shape (hereinafter also referred to as a "charging roller") as an example.

[Charging Member]

FIG. 1 is a cross-sectional view of a charging roller according to one aspect of the present invention in the direction orthogonal to the axis thereof. The charging roller has an electro-conductive substrate 1 and an electro-conductive elastic layer 2 laminated on the peripheral surface thereof. In addition, the charging roller has a protrusion derived from an aggregate of crosslinked rubber particles on the surface thereof. The average height of the protrusion derived from the aggregate of the crosslinked rubber particles is 50 nm or more and 200 nm or less. When the average height of the protrusion is 50 nm or more, toner can be rolled, and tribo can be provided. When the average height of the protrusion is 200 nm or less, the accumulation of contamination substances on the surface of the charging roller can be suppressed. The average height of the protrusion is more preferably 100 nm or more and 200 nm or less.

[Physical Properties of Charging Member]

Figure 4:
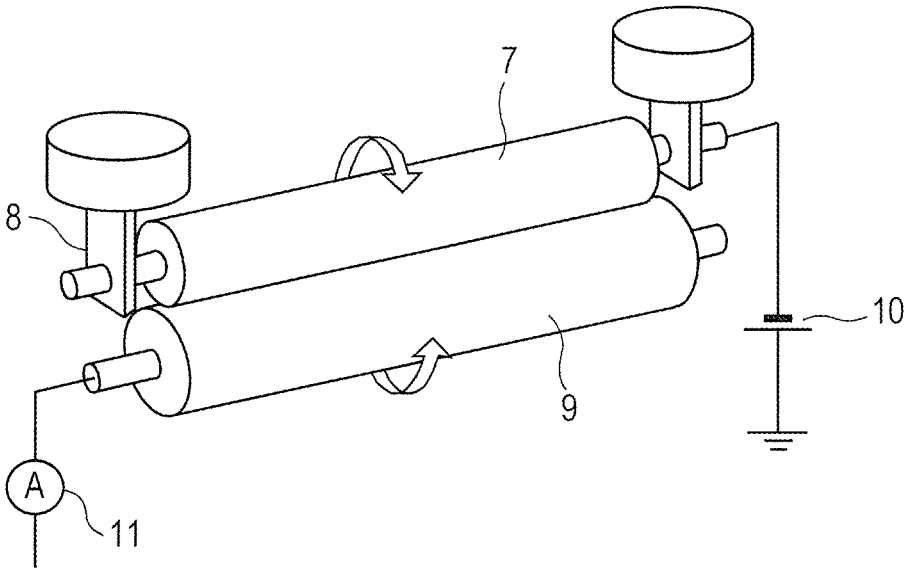
FIG. 4 is a schematic diagram of an apparatus used for the measurement of the electrical resistance value of a charging member.

The charging member can usually have an electrical resistance value of $1\times10^{2}\Omega$ or more and $1\times10^{10}\Omega$ or less in an environment of normal temperature and normal humidity (a temperature of 23° C. and a relative humidity of 50%) in order to make the charging of an electrophotographic photosensitive member good. A method for measuring the electrical resistance value of a charging member is illustrated in FIG. 4. Both ends of the electro-conductive support of a charging member 7 are rotatably held by bearings 8 under loads. The charging member 7 are allowed to abut a cylindrical metal 9 having the same curvature as an electrophotographic photosensitive member so as to be parallel to the cylindrical metal 9. While the cylindrical metal is rotated in the state by a motor (not shown) to drive the abutting charging member to rotate, a direct current voltage of −200 V is applied to the charging member from a stabilized power supply 10. The current flowing at the time is measured by an ammeter 11, and the electrical resistance value of the charging member is calculated. The load applied to each one end of the electro-conductive support is 4.9 N, the diameter of the cylindrical metal is 30 mm, and the rotation speed is a peripheral speed of 45 mm/sec.

The electro-conductive elastic layer can have a shape in which the outer diameter of the central portion in the longitudinal direction is the largest, and the outer diameter decreases along the directions of both ends in the longitudinal direction, the so-called crown shape, in order to make the width of a nip extending in the longitudinal direction with respect to a photosensitive member more uniform. As the amount of the crown, the difference between the outer diameter of the central portion in the longitudinal direction and the average value of outer diameters at two points on the left and right at positions 90 mm away from the central portion can be 30 μm or more and 200 μm or less. By setting the amount of the crown in the range, the state of contact between the charging member and an electrophotographic photosensitive member can be made more stable.

The hardness of the electro-conductive elastic layer is preferably 90° or less, more preferably 40° or more and 80° or less, in terms of microhardness (model MD-1). By setting the microhardness at 90° or less, in particular at 40° or more and 80° or less, it is easy to stabilize abutting a photosensitive member, and the photosensitive member can be more stably charged.

The microhardness (model MD-1) is hardness measured by pressing an indenter against the outer surface of the electro-conductive elastic layer using a micro rubber hardness meter (trade name: MD-1 capa; manufactured by Kobunshi Keiki Co., Ltd.). Specifically, the hardness is measured in a peak hold mode at 10 N with the indenter allowed to abut the surface of the electro-conductive elastic layer of the charging member that has been allowed to stand in an environment of normal temperature and normal humidity (a temperature of 23° C. and a relative humidity of 50%) for 12 hours or more. For the indenter, type A (height 0.50 mm, diameter 0.16 mm, cylindrical shape) is used. A portion other than the protrusion derived from the rubber particle aggregate is selected, and the indenter is allowed to abut the portion.

The hardness of the electro-conductive elastic layer can be adjusted by the type and amount of a vulcanizing agent included in a material mixture for electro-conductive elastic layer formation, the type and amount of a vulcanization aid, vulcanization temperature, vulcanization time and the content of a filler.

[Electro-Conductive Support]

The electro-conductive support has electro-conductivity and has the function of supporting a resin layer provided thereon. Examples of the material of the electro-conductive support can include metals such as iron, copper, aluminum and nickel, and alloys thereof (stainless steel and the like). In addition, for the purpose of providing scratch resistance, the surfaces of these may be subjected to plating treatment in a range that does not impair electro-conductivity. Further, as the electro-conductive support, a resin substrate having the surface coated with a metal, and a substrate produced from an electro-conductive resin composition can also be used.

[Electro-Conductive Elastic Layer]

<Binder>

As the binder constituting the electro-conductive elastic layer, a known rubber, elastomer, or resin can be used. From the viewpoint of ensuring a sufficient nip between the charging member and a photosensitive member, the electro-conductive elastic layer can have relatively low elasticity, and a rubber is suitably used as the binder. Examples of the rubber can include a natural rubber, a synthetic rubber, or rubbers obtained by vulcanizing and crosslinking these.

Examples of the synthetic rubber include the following rubbers: an ethylene propylene rubber, a styrene butadiene rubber (SBR), a silicone rubber, a urethane rubber, an isoprene rubber (IR), a butyl rubber, an acrylonitrile butadiene rubber (NBR), a chloroprene rubber (CR), an acrylic rubber, an epichlorohydrin rubber and a fluororubber.

<Crosslinked Rubber Particle>

Examples of the rubber particles constituting the aggregate of the crosslinked rubber particles include particles including the following rubbers: a polyurethane rubber, a silicone rubber, a butadiene rubber, an isoprene rubber, a chloroprene rubber, a styrene-butadiene rubber (SBR), an ethylene-propylene rubber, a polynorbornene rubber, an acrylonitrile rubber (NBR) and an epichlorohydrin rubber.

Particularly, crosslinked rubber particles including either one or both of an acrylonitrile rubber and a styrene-butadiene rubber is particularly preferred because the effect of suppressing the energization deterioration of the charging member is large.

The primary particle diameter of the crosslinked rubber particles can be 100 nm or more and 1000 nm or less. When the primary particle diameter is 100 nm or more, the deposition of contamination on the charging member is reduced. When the primary particle diameter is 1000 nm or less, toner can be charged negatively by rolling in a nip to provide tribo to the toner. The primary particle diameter of the crosslinked rubber particles is measured, for example, in terms of average particle diameter based on the CONTIN method using a thick type particle diameter analyzer (trade name: FPAR-1000, manufactured by Otsuka Electronics Co., Ltd.).

[Method for Preparing Crosslinked Rubber Particles]

The crosslinked rubber particles can be produced by polymerizing a raw material mixture including a monomer for a rubber, a crosslinking agent, a graft crossing agent, a polymerization initiator, an emulsifier and the like by a known method such as emulsion polymerization. A latex including crosslinked rubber particles is produced by emulsion polymerization.

The monomer for a rubber is not particularly limited. Examples thereof include the following monomers: 1-3 butadiene, isoprene (2-methyl-1,3-butadiene), chloroprene (2-chloro-1,3-butadiene), styrene, ethylene, propylene, acrylonitrile, norbornene, epichlorohydrin, ethylene oxide and allyl glycidyl ether. When the monomer for a rubber has two or more unsaturated double bonds in the molecule thereof (for example, 1,3-butadiene and isoprene (2-methyl-1,3-butadiene) and the like), the crosslinking agent and the graft crossing agent are not always necessary.

The crosslinking agent is not particularly limited. Examples thereof include sulfur and peroxides. The graft crossing agent is not particularly limited. Examples thereof include allyl methacrylate, triallyl cyanurate and triallyl isocyanurate.

The polymerization initiator is not particularly limited. Examples thereof include the following: water-soluble persulfuric acid salts such as potassium persulfate, sodium persulfate and ammonium persulfate; and organic peroxides such as diisopropylbenzene hydroperoxide, p-menthane hydroperoxide, cumene hydroperoxide, t-butyl hydroperoxide and methylcyclohexyl hydroperoxide. One of these polymerization initiators can be used alone, or two or more of these polymerization initiators can be used in combination.

The emulsifier is not particularly limited. Examples thereof include the following: alkali metal salts of higher fatty acids such as disproportionated rosin acid, oleic acid and stearic acid; sulfonic acid-based salt compounds such as sodium dodecylbenzenesulfonate and sodium alkyl diphenyl ether disulfonate; and sulfuric acid-based salt compounds such as sodium lauryl sulfate. One of these emulsifiers can be used alone, or two or more of these emulsifiers can be used in combination.

[Chemical Bond to Particle Surface]

The crosslinked rubber particles constituting the aggregate of the crosslinked rubber particles have one of an acrylic resin and a styrene acrylic resin chemically bonded to the surface thereof. Thus, the tackiness of the surface of the aggregate of the crosslinked rubber particles is reduced, and the strength of the surface of the aggregate of the crosslinked rubber particles is kept, and thus the durability when the charging member is used in an image forming apparatus improves. In addition, the accumulation of toner and an external additive on the surface of the electro-conductive elastic layer is suppressed, and therefore the contamination on the charging member can be suppressed. The form of the chemical bond can be a chemical bond by graft polymerization.

The graft polymerization can be carried out by adding a monomer mixed liquid for graft polymerization to a latex including crosslinked rubber particles obtained by the emulsion polymerization method, and performing polymerization by a known method. Thus, crosslinked rubber particles having one of an acrylic resin and a styrene acrylic resin chemically bonded to the surface (hereinafter also referred to as a "resin-coated crosslinked rubber particle") are produced. The method for confirming the presence or absence of a chemical bond will be described later.

[Acrylic Resin and Styrene Acrylic Resin]

Examples of the acrylic resin chemically bonded to the surface of the crosslinked rubber particles include a polymer obtained by polymerizing one or more monomers selected from the group consisting of acrylic acid, methacrylic acid, an acrylate and a methacrylate. Particularly, an acrylic resin obtained by polymerizing acrylic acid or methacrylic acid is suitably used.

Examples of the acrylic resin include a polymethacrylate such as polymethyl methacrylate, and a methacrylic copolymer including as a main component a methacrylate unit such as methyl methacrylate. Specific examples of the methacrylic copolymer include a copolymer of methyl methacrylate and a copolymerizable vinyl monomer.

Examples of the copolymerizable vinyl monomer include (meth)acrylates other than methyl methacrylate, such as methyl acrylate, ethyl (meth)acrylate, n-propyl (meth)acrylate, isopropyl (meth)acrylate, n-butyl (meth)acrylate, isobutyl (meth)acrylate, t-butyl (meth)acrylate, cyclohexyl (meth)acrylate, phenyl (meth)acrylate, benzyl (meth)acrylate, 2-ethylhexyl (meth)acrylate and 2-hydroxyethyl (meth) acrylate, and aromatic vinyl monomers such as styrene.

In addition, examples of the styrene acrylic resin chemically bonded to the surface of the crosslinked rubber particles include copolymers obtained by copolymerizing by a known method components mentioned below: styrene; styrene-based monomers such as α-methylstyrene, o-methylstyrene, m-methylstyrene, p-methylstyrene, p-methoxystyrene, p-ethylstyrene, 2,4-dimethylstyrene, p-n-butylstyrene, p-tert-butylstyrene, n-hexylstyrene, p-n-octylstyrene, p-n-nonylstyrene, p-n-decylstyrene, p-n-dodecylstyrene and p-phenylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, phenyl acrylate and 2-hydroxyethyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, 2-hydroxyethyl methacrylate, dimethylaminoethyl methacrylate and diethylaminoethyl methacrylate; acrylonitrile, methacrylonitrile and acrylamide; sulfonic acids such as styrenesulfonic acid, 2-acrylamido-2-methylpropanesulfonic acid, 2-methacrylamido-2-methylpropanesulfonic acid, vinylsulfonic acid and methacrylsulfonic acid; and maleic acid amide derivatives, maleimide derivatives, and styrene derivatives.

In the crosslinked rubber particles having one of an acrylic resin and a styrene acrylic resin chemically bonded to the surface, the proportion of the acrylic resin and/or the styrene acrylic resin chemically bonded to the surface to 100 parts by mass of the crosslinked rubber particles before one of the acrylic resin and the styrene acrylic resin is chemically bonded to the surface (hereinafter also referred to as an "untreated crosslinked rubber particles") is not particularly limited but can be 10 parts by mass or more and 30 parts by mass or less. When the proportion is 10 parts by mass or more, the rolling properties of toner and the durability of the rubber particle improve. When the proportion is 30 parts by mass or less, the flexibility of the crosslinked rubber particles is kept, and scraping the electrophotographic photosensitive member can be suppressed.

<Aggregate of Crosslinked Rubber Particles>

The aggregate of the crosslinked rubber particles is an aggregate of crosslinked rubber particles each of which is a primary particle, and is the so-called secondary particle. Here, the crosslinked rubber particle has one of an acrylic resin and a styrene acrylic resin chemically bonded to the surface. It is considered that by providing on the surface of the charging member the protrusion derived from the aggregate of the crosslinked rubber particles each of which is a primary particle, contamination adhering to the protrusion is likely to be incorporated into the aggregate of the crosslinked rubber particles. Therefore, it is considered that the accumulation of contamination substances on the protrusion is suppressed.

The aggregate of the crosslinked rubber particles can be obtained as a powder by dropping a latex including the resin-coated crosslinked rubber particles into a liquid including a coagulant to aggregate and solidify the crosslinked rubber particles followed by separation, washing and drying. As these aggregation and solidification to drying methods, known methods can be used. Examples of the coagulant include metal salts such as calcium acetate, aluminum sulfate and calcium chloride, and inorganic acids such as sulfuric acid, hydrochloric acid, phosphoric acid and nitric acid.

[Particle Diameter of Aggregate of Crosslinked Rubber Particles]

The particle diameter of the aggregate of the crosslinked rubber particles is 10 μm or more and 50 μm or less in terms of circle-equivalent diameter. When the particle diameter is 10 μm or more, rolling properties can be provided to toner. When the particle diameter is 50 μm or less, the adhesion of contamination substances to the surface of the charging member can be suppressed. The circle-equivalent diameter can be obtained by observing a cross section of the electro-conductive elastic layer by a microscope or the like. Specifically, a cross section of the electro-conductive elastic layer is observed by a transmission electron microscope (TEM), the projected area of the aggregate of the crosslinked rubber particles is obtained from image data of a cross section of the aggregate of the crosslinked rubber particles, and the circle-equivalent diameter is calculated from the area.

[Content of Aggregate of Crosslinked Rubber Particles]

The content of the aggregate of the crosslinked rubber particles in the electro-conductive elastic layer is 10% by mass or more and 50% by mass or less. When the content of the aggregate of the crosslinked rubber particles is 10% by mass or more, tribo providing properties to toner are exhibited. When the content of the aggregate of the crosslinked rubber particles is 50% by mass or less, the adhesion of contamination substances due to the deposition of an external additive of toner and the like can be suppressed on the surface of the charging member.

[Average Degree of Unevenness]

The surface of the aggregate of the crosslinked rubber particles has a minute protrusion shape. The average degree of unevenness of the aggregate of the crosslinked rubber particles can be measured by observing the surface of the charging member in the range of a field of view of 0.5 mm×0.5 mm using a laser microscope (trade name: LSM5 PASCAL; manufactured by Carl Zeiss). A specific measurement method is as follows.

The wavelength of the laser to be excited is changed, and the spectrum of the excitation light is examined to identify whether the protrusion in the field of view is derived from the aggregate of the crosslinked rubber particles or another particles. Scanning is performed in the X-Y plane in the field of view with a laser to obtain two-dimensional image data. From the obtained image data, the protrusion derived from the aggregate of the crosslinked rubber particles is cut from the apex of the protrusion in a direction parallel to the Z direction and parallel to the longitudinal direction of the charging member by a sharp-edged cutting tool (a razor blade, a utility knife or the like), a microtome or the like. The cut cross section is observed by an optical microscope or an electron microscope to obtain image data of the cross section of the aggregate of the crosslinked rubber particles. For the obtained image data, the ratio "A/B" of "actual cross-sectional peripheral length" A to "envelope peripheral length" B of the aggregate of the crosslinked rubber particles is obtained using image analysis software (trade name: Image-PRO Plus, manufactured by Planetron, Inc.), and the ratio is taken as the degree of unevenness (see FIG. 3).

Figure 3:
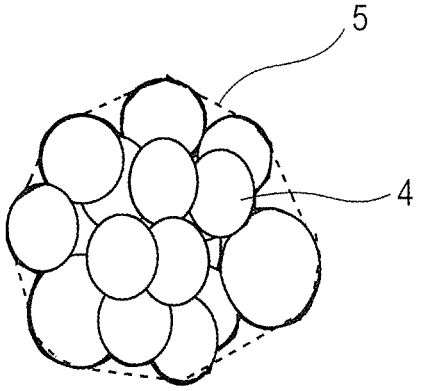
FIG. 3 is an explanatory diagram for obtaining the average degree of unevenness of the surface of an aggregate of crosslinked rubber particles.

Here, the "envelope peripheral length" refers to circumferential length when the protrusions in the cross section of the aggregate of the crosslinked rubber particles are connected (numeral 5 in FIG. 3). Such work is performed for protrusions derived from 10 aggregates of the crosslinked rubber particles, and the arithmetic mean of the 10 degrees of unevenness obtained is taken as the average degree of unevenness. The average degree of unevenness can be 1.10 or more and 1.30 or less. When the average degree of unevenness is 1.10 or more, the rolling providing properties to toner become good, and the tribo providing properties can be improved. In addition, when the average degree of unevenness is 1.30 or less, the collapse of the aggregate of the crosslinked rubber particles into the primary particle can be suppressed.

[Average Height of Protrusion]

The surface of the charging member according to one aspect of the present invention has a protrusion derived from an aggregate of a crosslinked rubber particles, and the average height of the protrusion is 50 nm or more and 200 nm or less. When the average height of the protrusion is 50 nm or more, the rolling properties of transfer residual toner on the surface of the charging member improve, and the negative charge providing properties to transfer residual toner improve. In addition, when the average height of the protrusion is 200 nm or less, the adhesion of contamination substances to the surface of the charging member can be suppressed.

Figure 2:
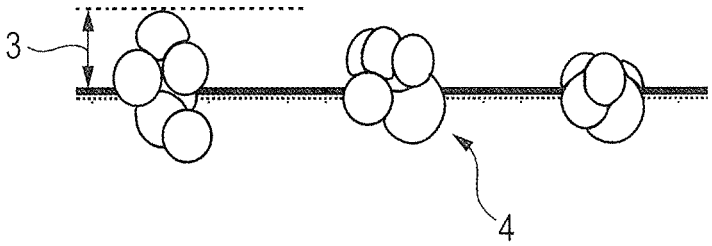
FIG. 2 is a diagram showing the height of a protrusion derived from an aggregate of crosslinked rubber particles.

The height of the protrusion (numeral 3 in FIG. 2) can be specifically measured, for example, by the following method. The surface of the electro-conductive elastic layer of the charging member is observed in a field of view of 0.5 mm×0.5 mm using a laser microscope (trade name: LSM5 PASCAL, manufactured by Carl Zeiss) as a measuring instrument. The wavelength of the laser to be excited is changed, and the spectrum of the excitation light is examined to identify whether the protrusion in the field of view is derived from the aggregate 4 of the crosslinked rubber particles or another additives or the like. Then, scanning is performed in the X-Y plane in the field of view with a laser to further detect the protrusion of the aggregate of the crosslinked rubber particles from two-dimensional image data. The work is performed for 10 aggregates of the crosslinked rubber particles in the field of view.

In addition, the above measurement is performed in each of 10 regions obtained by dividing the longitudinal direction of the charging member at generally equal intervals into 10 parts. With the apexes of the protrusions of a total of 100 aggregates of the crosslinked rubber particles obtained and the planar portion of the surface of the electro-conductive elastic layer as a reference plane, the heights of the protrusions of the aggregates of the crosslinked rubber particles are calculated. The average value of the heights of the 100 protrusions calculated is taken as "the average height of the protrusion."

<Electro-Conductive Material>

A known electro-conductive material can be contained in the electro-conductive elastic layer. Examples of the electro-conductive material include an electron-conductive agent and an ion-conductive agent.

Examples of the electron-conductive agent include the following: fine particles and fibers based on metals such as aluminum, palladium, iron, copper and silver; metal oxides such as titanium oxide, tin oxide and zinc oxide; composite materials obtained by surface-treating the surfaces of the metal-based fine particles and fibers and metal oxides by electrolytic treatment, spray coating or mixing and shaking; and carbon black and carbon-based fine particles.

Examples of the carbon black can include furnace black, thermal black, acetylene black and keten black. Examples of the furnace black include the following: SAF-HS, SAF, ISAF-HS, ISAF, ISAF-LS, I-ISAF-HS, HAF-HS, HAF, HAF-LS, T-HS, T-NS, MAF, FEF, GPF, SRF-HS-HM, SRF-LM, ECF and FEF-HS. Examples of the thermal black can include FT and MT. Examples of the carbon-based fine particles can include PAN (polyacrylonitrile)-based carbon particles and pitch-based carbon particles.

The surface of the electron-conductive agent may be treated with a surface treatment agent. As the surface treatment agent, organosilicon compounds such as alkoxysilanes, fluoroalkylsilanes and polysiloxanes, various coupling agents based on silane, titanates, aluminates and zirconates, oligomers or polymer compounds can be used. One of these can be used alone, or two or more of these can be used in combination. As the surface treatment agent, organosilicon compounds such as alkoxysilanes and polysiloxanes, and various coupling agents based on silane, titanates, aluminates or zirconates are preferred, and organosilicon compounds are further preferred.

When the electro-conductive material is a fine particle, the average particle diameter of the fine particle is more preferably 0.01 μm or more and 0.9 μm or less, further preferably 0.01 μm or more and 0.5 μm or less.

Examples of the ion-conductive agent include the following: inorganic ion substances such as lithium perchlorate, sodium perchlorate and calcium perchlorate; cationic surfactants such as lauryltrimethylammonium chloride, stearyltrimethylammonium chloride, octadecyltrimethylammonium chloride, dodecyltrimethylammonium chloride, hexadecyltrimethylammonium chloride, trioctylpropylammonium bromide and modified aliphatic dimethylethylammonium ethosulfate; zwitterionic surfactants such as lauryl betaine, stearyl betaine and dimethylalkyllauryl betaine; quaternary ammonium salts such as tetraethylammonium perchlorate, tetrabutylammonium perchlorate and trimethyloctadecylammonium perchlorate; and organic acid lithium salts such as lithium trifluoromethanesulfonate. One of these can be used alone, or two or more of these can be used in combination. When the binder is a polar rubber, particularly an ammonium salt can be used.

<Other Components>

In addition, an additive such as a softening oil or a plasticizer, or an inorganic particle may be contained in the electro-conductive elastic layer in order to adjust hardness.

Examples of the inorganic particle include the following: particles of zinc oxide, tin oxide, indium oxide, titanium oxide (titanium dioxide, titanium monoxide and the like), iron oxide, silica, alumina, magnesium oxide, zirconium oxide, strontium titanate, calcium titanate, magnesium titanate, barium titanate, calcium zirconate, barium sulfate, molybdenum disulfide, calcium carbonate, magnesium carbonate, dolomite, talc, kaolin clay, mica, aluminum hydroxide, magnesium hydroxide, zeolite, wollastonite, diatomaceous earth, glass beads, bentonite, montmorillonite, hollow glass spheres, organometallic compounds and organometallic salts.

In addition, iron oxides such as ferrite, magnetite and hematite, and activated carbon can also be used. One of these electro-conductive materials can be used alone, or two or more of these electro-conductive materials can be used in combination.

[Electrophotographic Image Forming Apparatus]

Figure 5:
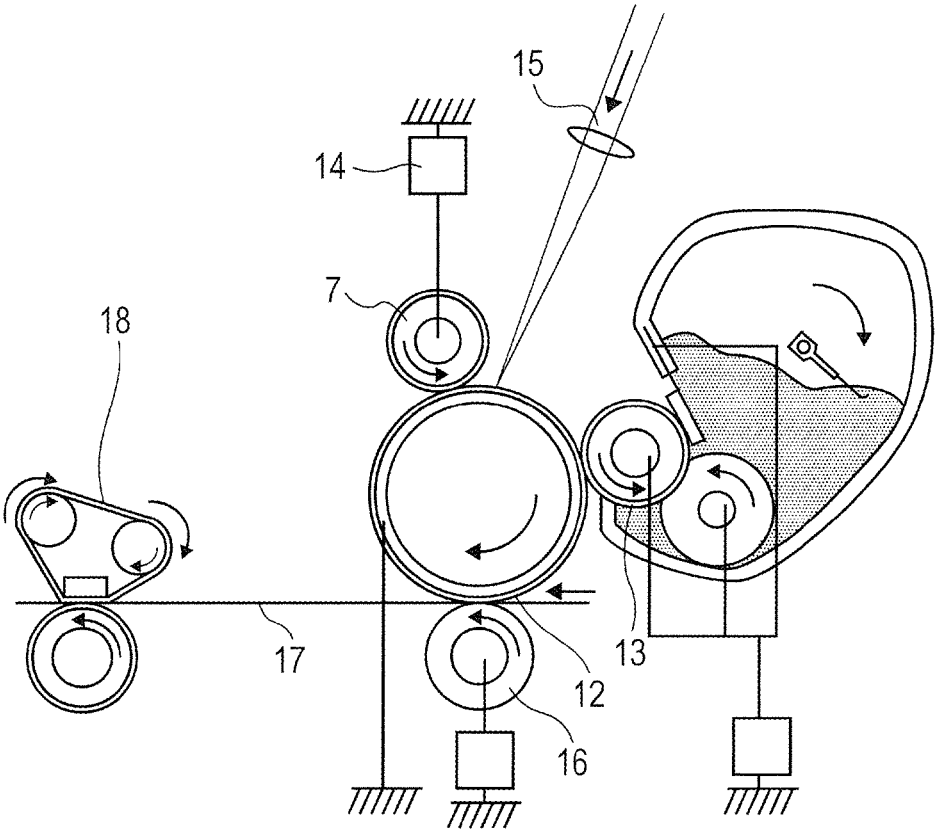
FIG. 5 is a schematic cross-sectional view of one example of an electrophotographic image forming apparatus according to the present invention.

An electrophotographic image forming apparatus according to one aspect of the present invention includes an electrophotographic photosensitive member and a charging member disposed in contact with the electrophotographic photosensitive member, and as the charging member, the charging member according to the present invention is used. The schematic configuration of one example of the electrophotographic image forming apparatus is illustrated in FIG. 5. The electrophotographic image forming apparatus includes an electrophotographic photosensitive member, a charging apparatus, an exposure apparatus, a developing apparatus, a transfer apparatus, a fixing apparatus and the like.

An electrophotographic photosensitive member 12 is a rotary drum type photosensitive member having a photosensitive layer on an electro-conductive support. The electrophotographic photosensitive member 12 is rotationally driven in a direction shown by an arrow at a predetermined peripheral speed (process speed). The charging apparatus has a contact type charging member (charging roller) 7 disposed in contact by being allowed to abut the electrophotographic photosensitive member 12 with a predetermined pressing pressure. The charging member 7 is driven to rotate according to the rotation of the electrophotographic photosensitive member 12. In addition, a predetermined direct current voltage is applied to the charging member 7 from a charging power supply 14, and the electrophotographic photosensitive member 12 can be charged to a predetermined potential. By irradiating the electrophotographic photosensitive member 12 uniformly charged by the charging apparatus with exposure light 15 corresponding to image information from a latent image forming apparatus (not shown), an electrostatic latent image is formed. For the latent image forming apparatus, for example, an exposure apparatus such as a laser beam scanner is used.

The developing apparatus has a developing sleeve or developing roller 13 disposed in proximity to or in contact with the electrophotographic photosensitive member 12. With toner electrostatically treated to the same polarity as the charging polarity of the electrophotographic otosensitive member 12, the electrostatic latent image is developed by reversal development to form a toner image. The transfer apparatus has a contact type transfer roller 16. The toner image is transferred from the electrophotographic photosensitive member 12 to a transfer material 17 such as plain paper. The transfer material is conveyed by a paper feed system having a conveying member. Here, in the electrophotographic image forming apparatus of the present invention, a cleanerless system in which transfer residual toner is recovered by a developing apparatus is adopted, and therefore no cleaning apparatus is present. A fixing apparatus 18 includes a heated roll and the like, and the transferred toner image is fixed to the transfer material 17, and the transfer material 17 is discharged out of the machine. The above is a series of electrophotographic processes.

[Process Cartridge]

Figure 6:
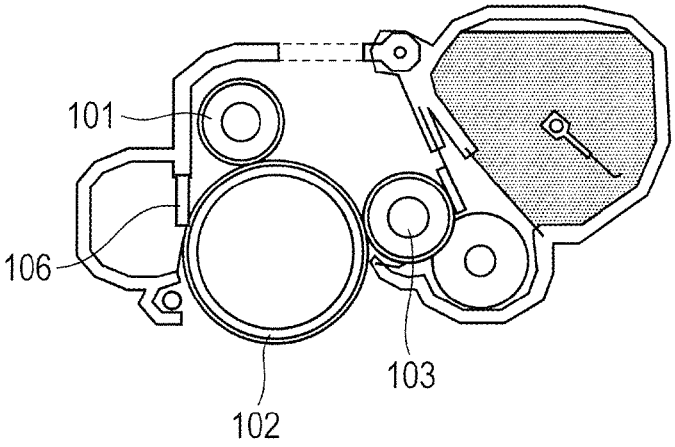
FIG. 6 is a schematic cross-sectional view of one example of a process cartridge according to the present invention.

The schematic configuration of one example of a process cartridge is illustrated in FIG. 6. In the process cartridge, an electrophotographic photosensitive member 102, a charging roller 101, a developing roller 103, a cleaning member 106 are integrated, and the process cartridge is configured to be attachable to and detachable from the main body of an electrophotographic image forming apparatus. The charging member according to one aspect of the present invention can be used as the charging roller of the process cartridge.

According to one aspect of the present invention, a charging member in which the adhesion of contamination substances to the surface is reduced can be obtained. In addition, according to another aspect of the present invention, an electrophotographic image forming apparatus and a process cartridge that can stably form high quality electrophotographic images can be obtained.

EXAMPLES

The present invention will be described in more detail below by giving specific examples, but the technical scope of the present invention is not limited to these. Commercial raw materials and reagents were used for materials not particularly described below. In addition, the units of amounts blended are parts by mass and % by mass unless otherwise described. An evaluation method regarding a chemical bond to the surfaces of crosslinked rubber particles is as follows.

1. Measurement of Graft Ratio

The amount (graft ratio) of an acrylic resin or a styrene acrylic resin chemically bonded to the surface of crosslinked rubber particles by graft polymerization was confirmed by the following method.

2.5 g of resin-coated crosslinked rubber particles and 100 ml of acetone were placed in a container, heated at 23° C. for 3 hours, and then centrifuged at 10000 rpm for 60 minutes using a centrifuge (H-2000B, rotor H, manufactured by KOKUSAN Co. Ltd.), and acetone-insoluble matter was recovered. Then, the acetone-insoluble matter was dried, the mass of the acetone-insoluble matter S was measured, and the graft ratio was obtained by the following formula:

$$\text{graft ratio}(\%\text{ by mass})=[(S-G)/G]\times 100$$

wherein G is the mass of the crosslinked rubber particles included in 2.5 g of the resin-coated crosslinked rubber particles, calculated from the ratio between the mass of the crosslinked rubber particles used in graft polymerization and the mass of the produced resin-coated crosslinked rubber particles.

Production Example 1

<Step 1>

An autoclave (practical pressure resistance 0.6 NpaG) was charged with the materials shown in the Component (1) column in the following Table 1, and the atmosphere in the autoclave was replaced by nitrogen. Subsequently, Component (2) in the following Table 1 was added to the autoclave. Then, the temperature was increased while the obtained mixed liquid was stirred, and at a point of time when the liquid temperature reached 45° C., a mixture of the materials shown in the Component (3) column in Table 1 was introduced into the autoclave, and the temperature was increased to 60° C. Then, at a point of time when the polymerization conversion rate in the above solution reached 97%, the polymerization was completed to obtain butadiene rubber polymer latex No. 1. The solids of the obtained butadiene rubber polymer latex accounted for 40%.

TABLE 1

| | Material | Parts by mass |
|---|---|---|
| Component (1) | Styrene | 25 |
| | Paramenthane hydroperoxide | 0.3 |
| | Na pyrophosphate (anhydrous) | 0.15 |
| | Potassium tallowate | 1.5 |
| | Deionized water | 140 |
| Component (2) | 1,3-Butadiene | 75 |
| Component (3) | Ferrous sulfate heptahydrate | 0.003 |
| | Hydrous crystal glucose | 0.2 |
| | Deionized water | 10 |

<Step 2>

The materials shown in the Component (4) column in the following Table 2 were placed in a reactor, and the atmosphere in the reactor was replaced by nitrogen. Then, the material shown in the Component (5) column was added to the reactor, and the liquid temperature was increased to 70° C. Then, a mixture of the materials shown in the Component (6) column in Table 2 was added to the reactor over 30 minutes, and the state was maintained for 100 minutes. Then, a mixture of the materials shown in the Component (7) column in Table 2 was added to the reactor over 30 minutes, and the state was maintained for 120 minutes to complete polymerization.

TABLE 2

| | Material | Parts by mass |
|---|---|---|
| Component (4) | Butadiene rubber polymer latex No. 1 | 583 (Solids 233) |
| | Deionized water | 85 |
| | Potassium tallowate | 5.0 |
| Component (5) | Sodium formaldehyde sulfoxylate dihydrate | 0.3 |
| Component (6) | Methyl methacrylate | 28 |
| | Ethyl acrylate | 7 |
| | Cumene hydroperoxide | 0.15 |
| Component (7) | Methyl methacrylate | 10 |
| | Cumene hydroperoxide | 0.05 |

The latex of the graft copolymer thus obtained was dropped into 200 parts of hot water in which 5.0% by mass of calcium acetate was dissolved to solidify the graft copolymer, and the graft copolymer was separated, washed, and dried at 75° C. for 16 hours to obtain particles of powdery butadiene rubber-based graft copolymer. The particles were particle No. 1.

The primary particle diameter, circle-equivalent diameter and average decree of unevenness of particle No. 1 were measured according to the above-described methods. In addition, particle No. 1 was an aggregate of a crosslinked rubber particles each of which was a primary particle.

Further, the fact that the crosslinked rubber particles constituting particle No. 1 had an acrylic resin chemically bonded to the surface was confirmed by the above-described method. Further, the graft ratio of the acrylic resin onto the crosslinked rubber particles was by mass. The measurement results are shown in Table 7.

Production Examples 2 and 3

The reaction temperature in <Step 1> of Production Example 1 was chanced from 60° C. to 50° C. or 70° C. Except for the change, butadiene rubber polymer latexes No. 2 and No. 3 were prepared as in <Step 1> of Production Example 1. Then, particle No. 2 and particle No. 3 were made as in <Step 2> of Production Example 1 except that the obtained butadiene rubber polymer latex No. 2 or No. 3 was used.

Production Examples 4 and 5

Butadiene rubber polymer latexes No. 4 and No. 5 were prepared as in <Step 1> of Production Example 1 except that the amount of deionized water added in <Step 1> of Production Example 1 was changed from 140 parts to 200 parts or 100 parts. Then, particle No. 4 and particle No. 5 were made as in <Step 2> of Production Example 1 except that the obtained butadiene rubber polymer latexes No. 4 and No. 5 were used.

Production Examples 6 and 7

In Production Example 1, the amount of "paramenthane hydroperoxide" blended in Component (1) in Table 1 was changed to 0.1 parts by mass or 0.6 parts by mass. Except for the change, butadiene rubber polymer latexes No. 6 and No. 7 were prepared as in <Step 1> of Production Example 1. Then, particle No. 6 and particle No. 7 were made as in <Step 2> of Production Example 1 except that the obtained butadiene rubber polymer latexes No. 6 and No. 7 were used.

Production Example 8

<Step 3>

[Step 3-1]

A mixture of the materials shown in the Component (9) column in the following Table 3 was added to 10 parts of butadiene rubber polymer latex No. 1 prepared in Production Example 1 (4 parts of solids), and the liquid temperature was increased to 70° C.

[Step 3-2]

Then, a mixture of the materials shown in the Component (10) column in Table 3 was added over 180 minutes, and the mixture was reacted at a temperature of 70° C. for 120 minutes to complete graft polymerization.

TABLE 3

| | Material | Parts by mass |
|---|---|---|
| Component (9) | Butadiene rubber polymer latex No. 1 | 10 |
| | Deionized water | 9.0 |
| | Sodium dodecylbenzenesulfonate | 0.9 |
| Component (10) | Acrylonitrile | 27 |
| | Styrene | 63 |
| | n-Octyl mercaptan | 1.8 |

The solids of the obtained graft copolymer latex No. 8 accounted for 40%. The latex of the graft copolymer was dropped into 200 parts of hot water in which 5.0% by mass of calcium acetate was dissolved to solidify the graft copolymer, and the graft copolymer was separated, washed, and dried at 75° C. for 16 hours to obtain particles of powdery butadiene rubber-based graft copolymer. The particles were particle No. 8.

Production Examples 9 and 10

The liquid temperature in [Step 3-1] of Production Example 8 was changed from 70° C. to 60° C. or 80° C. Except for the change, graft polymer latexes No. 9 and No. 10 were prepared as in <Step 3> of Production Example 8. Then, particle No. 9 and particle No. 10 were made as in <Step 3> of Production Example 8 except that graft polymer latexes No. 9 and No. 10 were used.

Production Examples 11 and 12

Particle No. 11 and particle No. 12 were made as in Production Example 8 except that the butadiene latex obtained in Step 1 of Production Example 4 or the butadiene latex obtained in Step 1 of Production Example 5 was used instead of "butadiene rubber polymer latex No. 1" in Production Example 8.

Production Examples 13 and 14

Particle No. 13 or particle No. 14 was made as in Production Example 8 except that the butadiene rubber polymer latex obtained in Production Example 6 or 7 was used instead of "butadiene rubber polymer latex No. 1" in Production Example 8. The evaluation results are shown in Table 7.

Production Example 15

<Step 4>

[Step 4-1]

A separable flask equipped with a condenser and a stirring blade was charged with the materials shown in the Component (11) column in the following Table 4, and the liquid temperature was increased to 80° C. Subsequently, the atmosphere in the flask was replaced by nitrogen with 200 ml/min of a nitrogen gas flow for 50 minutes, the material shown in the Component (12) column in Table 4 was added, and the mixture was allowed to stand for 5 minutes. Then, a mixture of the materials shown in the Component (13) column in Table 4 was placed in the flask over 10 minutes, and a liquid temperature of 80° C. was maintained for 100 minutes to complete the first-stage polymerization step for the production of a crosslinked rubber particle aggregate 15.

[Step 4-2]

Subsequently, a mixed liquid of the materials shown in the Component (14) column in Table 4 was introduced, and the mixture was allowed to stand for 5 minutes. Then, the material shown in the Component (15) column in Table 4 was added, and a mixed liquid of the materials shown in the Component (16) column in Table 4 was further dropped over 200 minutes. In the polymerization, the material shown in the Component (17) column in Table 4 was added three times, 45 minutes, 90 minutes and 125 minutes after the start of the dropping. The amount of the material shown in the Component (17) column in Table 4 added was 0.05 parts each time. Thus, the total amount added was 0.150 parts.

After the completion of the dropping, a liquid temperature of 80° C. was maintained for 150 minutes to complete the second-stage polymerization step to obtain a latex of a rubbery polymer (A) [polyalkyl (meth)acrylate-based composite rubber]. The polymerization rate of the rubbery polymer (A) was 99.9%. In addition, the solids of the latex accounted for 92.7%.

TABLE 4

| | Material | Parts by mass |
|---|---|---|
| Component (11) | Boric acid | 0.3 |
| | Sodium carbonate | 0.03 |
| | Deionized water | 200 |
| Component (12) | Potassium persulfate | 0.7 |
| Component (13) | n-Butyl acrylate | 10 |
| | Allyl methacrylate | 0.5 |
| | n-Octyl mercaptan | 0.5 |
| Component (14) | Ferrous sulfate | 0.002 |
| | Disodium ethylenediaminetetraacetate salt | 0.006 |
| | Sodium hydroxymethanesulfinate dihydrate (Rongalite) | 0.1 |
| | Deionized water | 5 |

TABLE 4-continued

| | Material | Parts by mass |
|---|---|---|
| Component (15) | Sodium lauryl sulfate | 0.05 |
| Component (16) | n-Butyl acrylate | 75 |
| | Allyl methacrylate | 0.375 |
| | tert-Butyl peroxide | 0.075 |
| Component (17) | Sodium lauryl sulfate | 0.150 |

<Step 5> Graft Polymerization

The temperature of the latex of the rubbery polymer (A) was decrease to 65° C., and the system was charged with a mixture of other materials shown in the Component (18) column in the following Table 5. Subsequently, a mixture of the materials shown in the Component (19) column in Table 5 was further introduced into the system to perform graft polymerization. Subsequently, the state was maintained for 150 minutes to complete the polymerization to obtain a latex of an acrylic rubber-based graft copolymer including the rubbery polymer (A) and a graft portion (B). The latex of the graft copolymer was dropped into 200 parts of hot water in which 5.0% by mass of calcium acetate was dissolved to solidify the graft copolymer, and the graft copolymer was separated, washed, and dried at 75° C. for 16 hours to obtain particles of powdery acrylic rubber-based graft copolymer. The particles were particle No. 15. Particle No. 15 was an aggregate of crosslinked rubber particles each of which was a primary particle.

TABLE 5

| | Material | Parts by mass |
|---|---|---|
| Component (18) | Latex of rubbery polymer (A) | 75 |
| | Methyl methacrylate | 13 |
| | Butyl acrylate | 2 |
| | Allyl methacrylate | 0.15 |
| Component (19) | Sodium lauryl sulfate | 0.05 |
| | Sodium hydroxymethanesulfinate dihydrate (Rongalite) | 0.05 |
| | Deionized water | 10 |

Production Examples 16 and 17

Particle No. 16 and particle No. 17 were made as in <Step 4> and <Step 5> of Production Example 15 except that the reaction temperature in [Step 4-1] of Production Example 15 was changed from 80° C. to 70° C. or 90° C.

Production Examples 18 and 19

The number of parts of the added deionized water in Component (11) in [Step 4-1] of Production Example 15 was changed to 300 parts or 100 parts, and the holding time after the mixture of the materials shown in the Component (13) column was added to the flask, in [Step 4-1], was changed from 100 minutes to 240 minutes. Except for the changes, latexes were prepared as in <Step 4> of Production Example 15. Then, particle No. 18 and particle No. 19 were made as in <Step 5> of Production Example 15 except that the obtained latexes were used.

Production Examples 20 and 21

The conditions of the polymerization step in [Step 4-2] of Production Example 15 were changed from a temperature of 80° C. and a time of 150 minutes to a temperature of 70° C. and a time of 100 minutes or a temperature of 80° C. and a time of 240 minutes. Except for the changes, latexes were prepared as in <Step 4> of Production Example 15. Then, particle No. 20 and particle No. 21 were made as in <Step 5> of Production Example 15 except that these latexes were used.

Production Example 22

The latex of the rubbery polymer (A) prepared in <Step 4> of Production Example 15 was provided. Particle No. 22 was made as in <Step 3-1> and <Step 3-2> of Production Example 8 except that the latex was used.

Production Examples 23 and 24

Latexes were prepared as in <Step 4> of Production Example 15 except that the reaction temperature in the first-stage polymerization step in [Step 4-1] of Production Example 15 was changed from 80° C. to 70° C. or 90° C. Particle No. 23 and particle No. 24 were made as in <Step 3-1> and <Step 3-2> of Production Example 8 except that these latexes were used.

Production Examples 25 and 26

The latexes prepared in Production Example 18 and Production Example 19 were provided. Particle No. 25 and particle No. 26 were made as in <Step 3-1> and <Step 3-2> of Production Example 8 except that these latexes were used.

Production Examples 27 and 28

The latexes prepared in Production Example 20 and Production Example 21 were provided. Particle No. 27 and particle No. 28 were made as in <Step 3-1> and <Step 3-2> of Production Example 8 except that these latexes were used.

Production Example 29

Butadiene rubber polymer latex No. 1 prepared in <Step 1> of Production Example 1 was dried to obtain particle No. 29.

Production Examples 30 and 31

The reaction temperature after the introduction of the mixture of the materials shown in the Component (3) column in Table 1 into the autoclave in <Step 1> of Production Example 1 was changed from 60° C. to 80° C. or 45° C. Except for the change, butadiene rubber polymer latexes were prepared as in <Step 1> of Production Example 1. Then, particle No. 30 and particle No. 31 were made as in <Step 2> of Production Example 1 except that these butadiene rubber polymer latexes were used.

Production Example 32

A polyethylene resin particle having a protrusion shape (trade name: FLO-THENE UF-4; manufactured by Sumitomo Seika Chemicals Company Limited) was subjected to corona treatment by a corona treatment apparatus (APW-602F, manufactured by KASUGA DENKI, INC.) to obtain a polyethylene resin particle provided with hydrophilicity. The polyethylene resin particle will be also referred to as a "surface-treated polyethylene resin particle" below. 47 g of the surface-treated polyethylene resin particle was introduced into 230 g of a 10% by volume methanol solution of glycidyl methacrylate and dispersed to obtain a dispersion. The dispersion was stirred under a nitrogen atmosphere for 2 hours with the temperature kept at 50° C. Subsequently, the dispersion was filtered, and the filtered material was washed with methanol. Then, filtration was performed again followed by vacuum drying at a temperature of 60° C. for 10 hours. Thus, particle No. 32 having glycidyl methacrylate chemically bonded to the surface (67 g) was obtained.

TABLE 6

| | Material | Parts by mass |
|---|---|---|
| Component (20) | Corona-treated polyethylene particle | 47 |
| | 10 vol % glycidyl methacrylate/methanol solution | 230 |

The outlines and physical properties (the primary particle diameter, the circle-equivalent diameter of the aggregate, and the average degree of unevenness) of particles Nos. 1 to 32 are shown in Table 7.

In addition, whether each particle is an aggregate of crosslinked rubber particles or not is also shown together in Table 7. When the particle is an aggregate of crosslinked rubber particles, "A" of Aggregate is shown. When the particle is not an aggregate of crosslinked rubber particles, "S" of Single is shown.

TABLE 7

| | | Rubbery polymer (A) | | | | | Particle | | | |
|---|---|---|---|---|---|---|---|---|---|---|
| | | Particle No. | Butadiene (Parts by mass) | Acrylic rubber (Parts by mass) | Graft portion material | Graft ratio % By mass | Primary particle diameter (nm) | Circle-equivalent diameter of aggregate (μm) | Average degree of unevenness | State of crosslinked rubber particle A: Aggregate S: Single |
| Production Example | 1 | 1 | 25 | — | Acrylic | 20 | 500 | 25 | 1.20 | A |
| | 2 | 2 | 25 | — | Acrylic | 18 | 400 | 10 | 1.20 | A |
| | 3 | 3 | 25 | — | Acrylic | 23 | 800 | 50 | 1.20 | A |
| | 4 | 4 | 25 | — | Acrylic | 15 | 200 | 25 | 1.05 | A |
| | 5 | 5 | 25 | — | Acrylic | 22 | 1000 | 25 | 1.35 | A |
| | 6 | 6 | 25 | — | Acrylic | 18 | 50 | 25 | 1.10 | A |
| | 7 | 7 | 25 | — | Acrylic | 28 | 1100 | 25 | 1.30 | A |

TABLE 7-continued

| | Particle No. | Rubbery polymer (A) Butadiene (Parts by mass) | Rubbery polymer (A) Acrylic rubber (Parts by mass) | Graft portion material | Graft ratio % By mass | Particle: Primary particle diameter (nm) | Particle: Circle-equivalent diameter of aggregate (μm) | Particle: Average degree of unevenness | Particle: State of crosslinked rubber particle A: Aggregate S: Single |
|---|---|---|---|---|---|---|---|---|---|
| 8 | 8 | 25 | — | Styrene acrylic | 25 | 500 | 25 | 1.20 | A |
| 9 | 9 | 25 | — | Styrene acrylic | 15 | 400 | 10 | 1.20 | A |
| 10 | 10 | 25 | — | Styrene acrylic | 24 | 800 | 50 | 1.20 | A |
| 11 | 11 | 25 | — | Styrene acrylic | 22 | 200 | 25 | 1.05 | A |
| 12 | 12 | 25 | — | Styrene acrylic | 23 | 1000 | 25 | 1.35 | A |
| 13 | 13 | 25 | — | Styrene acrylic | 17 | 50 | 25 | 1.10 | A |
| 14 | 14 | 25 | — | Styrene acrylic | 29 | 1100 | 25 | 1.30 | A |
| 15 | 15 | — | 25 | Acrylic | 22 | 400 | 25 | 1.20 | A |
| 16 | 16 | — | 25 | Acrylic | 20 | 300 | 10 | 1.20 | A |
| 17 | 17 | — | 25 | Acrylic | 26 | 700 | 50 | 1.20 | A |
| 18 | 18 | — | 25 | Acrylic | 18 | 100 | 25 | 1.05 | A |
| 19 | 19 | — | 25 | Acrylic | 24 | 800 | 25 | 1.35 | A |
| 20 | 20 | — | 25 | Acrylic | 17 | 50 | 25 | 1.10 | A |
| 21 | 21 | — | 25 | Acrylic | 29 | 1100 | 25 | 1.30 | A |
| 22 | 22 | — | 25 | Styrene acrylic | 22 | 400 | 25 | 1.20 | A |
| 23 | 23 | — | 25 | Styrene acrylic | 19 | 300 | 10 | 1.20 | A |
| 24 | 24 | — | 25 | Styrene acrylic | 25 | 700 | 50 | 1.20 | A |
| 25 | 25 | — | 25 | Styrene acrylic | 21 | 100 | 25 | 1.05 | A |
| 26 | 26 | — | 25 | Styrene acrylic | 23 | 800 | 25 | 1.35 | A |
| 27 | 27 | — | 25 | Styrene acrylic | 18 | 50 | 25 | 1.10 | A |
| 28 | 28 | — | 25 | Styrene acrylic | 26 | 1100 | 25 | 1.30 | A |
| 29 | 29 | 25 | — | None | 0 | 500 | 25 | 1.20 | A |
| 30 | 30 | 25 | — | Acrylic | 15 | 400 | 60 | 1.20 | A |
| 31 | 31 | 25 | — | Acrylic | 12 | 400 | 8 | 1.20 | A |
| 32 | 32 | * Polyethylene particle | | Acrylic | 15 | — | 25 | 1.20 | S |

Example 1

1. Making of Electro-Conductive Rubber Composition

The materials shown in the following Table 8 were blended so that the total amount was 4.8 kg, and the blend was kneaded in a 6-liter kneader "TD6-15MDX" (trade name, manufactured by Toshin Co., Ltd.) adjusted to 50° C. for 20 minutes to obtain a rubber composition.

TABLE 8

| Material | Parts by mass |
|---|---|
| Medium high acrylonitrile-butadiene rubbe (trade name: N230SV; manufactured by JSR Corporation) Amount of bonded acrylonitrile: 35.0%; Mooney viscosity ($ML_{1+4}$ 100° C.): 32; Specific gravity 0.98 | 100 |
| Calcium carbonate (trade name: Silver W, manufactured by Shiraishi Kogyo Kaisha, Ltd.) | 20 |
| Zinc stearate (trade name: SZ-2000, manufactured by Sakai Chemical Industry Co., Ltd.) | 1 |
| Zinc oxide (trade name: Zinc Oxide No. 2, manufactured by Sakai Chemical Industry Co., Ltd.) | 5 |
| Carbon black (trade name: TOKABLACK #7360SB, manufactured by Tokai Carbon Co., Ltd.) Arithmetic mean particle diameter: 28 nm; Nitrogen adsorption specific surface area 77 $m^2/g$; Amount of DBP absorbed (A method): 87 $cm^3/100$ g. | 48 |
| Particle No. 1 | 75 |

To 100 parts by mass (4.0 kg) of the rubber composition, other materials shown in the following Table 9 as vulcanizing agents were added, and the mixture was kneaded by a 12-inch two-roll machine (manufactured by KANSAI ROLL Co., Ltd.) cooled to 20° C. for 10 minutes to make an electro-conductive rubber composition 1.

TABLE 9

| Material | Parts by mass |
|---|---|
| Rubber composition | 100 |
| Sulfur | 1.0 |
| Vulcanization accelerator tetrabenzylthiuram disulfide (trade name: SANCELER TBzTD, manufactured by SANSHIN CHEMICAL INDUSTRY CO., LTD.) | 5.0 |

2. Making of Charging Member

Next, an electro-conductive support (material: SUS material, length: 252 mm, diameter: 6 mm) was provided. Using a crosshead extrusion apparatus having a cylinder diameter of 70 mm (manufactured by MITSUBA MFG. CO., LTD.), the electro-conductive rubber composition was extruded around the electro-conductive support as the central axis to obtain an unvulcanized rubber roller in which the outer periphery of the electro-conductive support was coated with a layer of the electro-conductive rubber composition. At the time, the thickness of the layer of the electro-conductive rubber composition was adjusted to 1.5 mm, and the outer diameter of the unvulcanized rubber roller was adjusted to 9.0 mm. The unvulcanized rubber roller after the extrusion was heated in a hot air furnace at 170° C. for 1 hour to vulcanize the rubber, and then the ends of the vulcanized rubber layer were removed to set the length of the rubber layer at 228 mm.

The outer peripheral surface of the obtained roller was polished using a plunge type rotary polishing machine (trade name: LEO-600-F4L-BME, manufactured by MINAKUCHI MACHINERY WORKS LTD.). A vitrified wheel was used as the polishing grindstone, and the abrasive grain was green silicon carbide GC, and the particle size was 100 mesh. The number of revolutions of the roller work was 350 rpm, and the number of revolutions of the polishing grindstone was 2000 rpm.

The rotation direction of the roller and the rotation direction of the polishing grindstone were the same (the direction of being driven). Polishing was performed with the cutting speed set at 20 mm/min and the spark-out time (time at a cutting of 0 mm) set at 0 seconds, thereby making charging member No. 1 in which the outer diameter of the central portion of the roller in the longitudinal direction was 8.5 mm. The thickness of the electro-conductive elastic layer was adjusted to 1.5 mm. The grindstone shape was adjusted so that the amount of the crown (the difference between the outer diameter of the central portion and the average value of outer diameters at positions each 90 mm away from the central portion in the directions of both ends) of the roller was 120 μm.

A cross section of the obtained elastic layer was observed by a transmission electron microscope (trade name: H-7100FA, manufactured by Hitachi High-Technologies Corporation), the projected area was obtained, and then the circle-equivalent diameter of the particle was calculated. As a result, the circle-equivalent diameter of particle No. 1 was 25 μm.

3. Image Evaluation with Charging Member

As an electrophotographic image forming apparatus for evaluation, a monochrome laser printer (trade name: LaserJet P4515n, manufactured by HP Japan Inc.) having the configuration illustrated in FIG. 5 was provided. In addition, one process cartridge for the above laser printer was provided. The charging member No. 1 was mounted in the process cartridge. The charging member was allowed to abut the electrophotographic photosensitive member with a pressing pressure of 4.9 N at one end, 9.8 N in total at both ends, by springs.

Each process cartridge was loaded into the electrophotographic image forming apparatus and adapted in an environment of a temperature of 5° C. and a relative humidity of for 24 hours. Subsequently, images were output in the same environment. In image formation, an alternating voltage having a peak-to-peak voltage of 1800 V and a frequency of 2930 Hz and a direct current voltage of −600 V were externally applied to the charging member. In addition, the resolution of the images output was 600 dpi. As the transfer material, letter size plain paper (trade name: XEROX 4024, manufactured by Fuji Xerox Co., Ltd.) was used.

The image output here was specifically an image in which horizontal lines having a width of 2 dots in the direction perpendicular to the rotation direction of the electrophotographic photosensitive member were drawn at intervals of 176 dots in the rotation direction.

In addition, images were output in the so-called intermittent mode in which the rotation of the electrophotographic photosensitive member was stopped for 3 seconds each time two images were continuously output. After 100 (0.1 K) images were output, after 10000 (10 K) images were output, after 20000 (20 K) images were output, and after 30000 (30 K) images were output, a halftone image (an image in which horizontal lines having a width of 1 dot in the direction perpendicular to the rotation direction of the photosensitive member were drawn at intervals of 2 dots in the rotation direction) was output. The four halftone images obtained were visually observed and evaluated according to the following criteria:

Rank A: No density unevenness occurs in any of the four halftone images.

Rank B: Only slight density unevenness is noted in any one of the four halftone images.

Rank C: Density unevenness is confirmed in at least one of the four halftone images.

Rank D: Density unevenness is conspicuous and a decrease in image quality is noted in at least one of the four halftone images.

4. Evaluation with Cleanerless Mechanism

The process cartridge of the monochrome laser printer was converted as follows: a gear such that the charging portion roller rotated in the forward direction with respect to the rotation of the photosensitive drum with a peripheral speed difference of 10% was attached, and the cleaning blade was removed. Charging member No. 1 was incorporated into the converted process cartridge, and 1000 images were output as in the above "3. Image Evaluation with Charging Member" using the monochrome laser printer. Subsequently, charging member No. 1 was removed from the process cartridge, and the contamination of the charging member was evaluated by the following method.

A polyester adhesive tape (trade name: No. 31B; manufactured by Nitto Denko Corporation, thickness=0.053 mm, peel adhesion=5.6 N/19 mm, tensile strength=115 N/19 mm, elongation=100%) was affixed to the surface of the entire image printing region of the charging roller, and the adhesive tape was peeled together with contamination adhering to the surface of the charging roller, and affixed to letter size plain paper (trade name: XEROX 4024, manufactured by Fuji Xerox Co., Ltd.).

The reflection density of the adhesive tape was measured by a photovoltaic reflection densitometer (trade name: TC-6DS/A, manufactured by Tokyo Denshoku Co., Ltd.) for the entire image printing region, and the maximum value Cmax was obtained. Next, the reflection density of an unused polyester tape also affixed to the letter size plain paper was measured, and the minimum value Cmin was obtained, and the difference between both values, "ΔC=Cmax−Cmin," was adopted as "the value of coloring density." The smaller the value of coloring density is, the smaller the amount of contamination on the surface of the charging member is. Therefore, the value of coloring density was taken as an indicator of the contamination of the charging member in the cleanerless system. The evaluation result is shown in Table 10.

Examples 2 to 52

In Example 1, the type of the aggregate of the crosslinked rubber particles and the amount of the aggregate of the crosslinked rubber particles used were changed, and the polishing conditions such as a spark-out time in a polishing process and a number of revolutions of a work to be polished, i.e. a roller were adjusted as shown in Tables 10 to 13, and changed the average height of the protrusion. Except for these, charging members were made and evaluation was performed as in Example 1. The charging roller production conditions and evaluation results are shown in Tables 10 to 13. The circle-equivalent diameter is also shown in Table 7

Comparative Example 1

In Example 1, the aggregate of the crosslinked rubber particles was not added. Except for this, a charging members was made and evaluation was performed as in Example 1. The charging member production conditions and evaluation results are shown in Table 14.

Comparative Examples 2 to 4

In Example 1, the type of the aggregate of the crosslinked rubber particles and the amount of the aggregate of the crosslinked rubber particles used were changed, and the polishing conditions were adjusted to change the average height of the protrusion. Except for these, charging members were made and evaluation was performed as in Example 1. The charging member production conditions and evaluation results are shown in Table 14.

Comparative Examples 5 and 6

Charging members were made and evaluation was performed as in Example 1 except that in Example 1, the polishing conditions were adjusted to change the average height of the protrusion. The charging member production conditions and evaluation results are shown in Table 14.

Comparative Examples 7 and 8

Charging members were made and evaluation was performed as in Example 1 except that in Example 1, the number of parts of the aggregate of the crosslinked rubber particles added was changed. The charging member production conditions and evaluation results are shown in Table 14.

Comparative Example 9

A Charging member was made and evaluation was performed as in Example 1 except that in Example 1, the aggregate of the crosslinked rubber particles was changed to the particle obtained in Production Example 32 (a particle that was not an aggregate of crosslinked rubber particles). The charging member production conditions and evaluation results are shown in Table 14.

[Consideration of Evaluation Results]

Examples 1 to 13 are Examples using an aggregate of crosslinked rubber particles in which an acrylic resin is chemically bonded to the surface of a butadiene rubber particle and are the same except that the primary particle diameter, the circle-equivalent diameter, the average height of the protrusion, the average degree of unevenness, the polishing conditions (the polishing time (spark-out time)) and the amount added are changed. Examples 14 to 26 are each an Example using an aggregate of crosslinked rubber particles in which a styrene acrylic resin is chemically bonded to the surface of a butadiene rubber particle. Examples 27 to 39 are Examples using an aggregate of crosslinked rubber particles in which an acrylic resin is chemically bonded to the surface of an acrylic rubber particle. Examples 40 to 52 are Examples using an aggregate of crosslinked rubber particles in which a styrene acrylic resin is chemically bonded to the surface of an acrylic rubber particle. In the above Examples 1 to 52, in the image evaluation, both in the initial image and in the image after endurance, contamination due to the adhesion of an external additive and toner to the charging member was suppressed, and the durability was excellent in image formation.

On the other hand, in Comparative Example 1, an aggregate of crosslinked rubber particles was not contained, and therefore a large amount of transfer residual toner adhered to the charging member, and the image forming properties were insufficient. For Comparative Examples 2 to 8, any one or more of the circle-equivalent diameter of the aggregate of the crosslinked rubber particles, the average height of the protrusion, and the amount added were outside the scope of the present invention, the durability was insufficient in image formation, and the contamination resistance of the cleanerless system was also insufficient. In Comparative Example 9, contamination adhering to the protrusion derived from the resin particle could not be incorporated into the resin particle, and therefore a large amount of transfer residual toner adhered to the charging member, and the image forming properties were insufficient.

TABLE 10

| | | | Example | | | | | | |
|---|---|---|---|---|---|---|---|---|---|
| | | | 1 | 2 | 3 | 4 | 5 | 6 | 7 |
| Particle | Elastic layer | | NBR | NBR | NBR | NBR | NBR | NBR | NBR |
| | Particle No. | | 1 | 2 | 2 | 2 | 2 | 3 | 3 |
| | Graft portion | | Acrylic | Acrylic | Acrylic | Acrylic | Acrylic | Acrylic | Acrylic |
| | Butadiene | Parts | 25 | 25 | 25 | 25 | 25 | 25 | 25 |
| | Primary particle diameter | nm | 500 | 400 | 400 | 400 | 400 | 800 | 800 |
| | Circle-equivalent diameter | μm | 25 | 10 | 10 | 10 | 10 | 50 | 50 |
| | Average degree of unevenness | | 1.20 | 1.20 | 1.20 | 1.20 | 1.20 | 1.20 | 1.20 |
| | Content ratio in electro-conductive elastic layer | % by mass | 30 | 10 | 50 | 50 | 10 | 10 | 50 |
| Number of revolutions of polishing work | | rpm | 350 | 350 | 350 | 350 | 350 | 350 | 350 |
| Spark-out time in polishing process | | sec | 2.5 | 5.0 | 5.0 | 1.0 | 1.0 | 5.0 | 5.0 |
| Average height of protrusion derived from crosslinked rubber particles on surface of charging member | | nm | 100 | 50 | 50 | 200 | 200 | 50 | 50 |
| | Image evaluation | VDG 0.1K | A | A | A | A | A | A | A |
| | | VDG 10K | A | A | B | B | A | A | A |
| | | VDG 20K | A | B | B | B | A | B | B |
| | | VDG 30K | A | B | B | B | A | B | B |
| | Contamination evaluation | ΔC | 10.5 | 10.2 | 12.5 | 13.0 | 12.0 | 11.1 | 12.1 |

| | | | Example | | | | | |
|---|---|---|---|---|---|---|---|---|
| | | | 8 | 9 | 10 | 11 | 12 | 13 |
| Particle | Elastic layer | | NBR | NBR | NBR | NBR | NBR | NBR |
| | Particle No. | | 3 | 3 | 4 | 5 | 6 | 7 |
| | Graft portion | | Acrylic | Acrylic | Acrylic | Acrylic | Acrylic | Acrylic |
| | Butadiene | Parts | 25 | 25 | 25 | 25 | 25 | 25 |
| | Primary particle diameter | nm | 800 | 800 | 200 | 1000 | 50 | 1100 |
| | Circle-equivalent diameter | μm | 50 | 50 | 25 | 25 | 25 | 25 |

TABLE 10-continued

| | | | | | | | |
|---|---|---|---|---|---|---|---|
| Average degree of unevenness | | 1.20 | 1.20 | 1.05 | 1.35 | 1.10 | 1.30 |
| Content ratio in electro-conductive elastic layer | % by mass | 50 | 10 | 30 | 30 | 30 | 30 |
| Number of revolutions of polishing work | rpm | 350 | 350 | 350 | 350 | 350 | 350 |
| Spark-out time in polishing process | sec | 1.0 | 1.0 | 1.0 | 1.0 | 1.0 | 1.0 |
| Average height of protrusion derived from crosslinked rubber particles on surface of charging member | nm | 200 | 200 | 200 | 200 | 200 | 200 |
| Image evaluation | VDG 0.1K | A | A | A | A | A | A |
| | VDG 10K | A | A | B | B | B | B |
| | VDG 20K | B | A | B | B | B | B |
| | VDG 30K | B | A | B | B | B | B |
| Contamination evaluation | ΔC | 12.8 | 11.5 | 18.0 | 17.6 | 18.6 | 19.6 |

TABLE 11

| | | | Example | | | | | | |
|---|---|---|---|---|---|---|---|---|---|
| | | | 14 | 15 | 16 | 17 | 18 | 19 | 20 |
| Elastic layer | | | NBR | NBR | NBR | NBR | NBR | NBR | NBR |
| Particle | Particle No. | | 8 | 9 | 9 | 9 | 9 | 10 | 10 |
| | Graft portion | | Styrene acrylic | Styrene acrylic | Styrene acrylic | Styrene acrylic | Styrene acrylic | Styrene acrylic | Styrene acrylic |
| | Butadiene | Parts | 25 | 25 | 25 | 25 | 25 | 25 | 25 |
| | Primary particle diameter | nm | 500 | 400 | 400 | 400 | 400 | 800 | 800 |
| | Circle-equivalent diameter | μm | 25 | 10 | 10 | 10 | 10 | 50 | 50 |
| | Average degree of unevenness | | 1.20 | 1.20 | 1.20 | 1.20 | 1.20 | 1.20 | 1.20 |
| | Content ratio in electro-conductive elastic layer | % by mass | 30 | 10 | 50 | 50 | 10 | 10 | 50 |
| Number of revolutions of polishing work | | rpm | 350 | 350 | 350 | 350 | 350 | 350 | 350 |
| Spark-out time in polishing process | | sec | 2.5 | 5.0 | 5.0 | 1.0 | 1.0 | 5.0 | 5.0 |
| Average height of protrusion derived from crosslinked rubber particles on surface of charging member | | nm | 100 | 50 | 50 | 200 | 200 | 50 | 50 |
| Image evaluation | | VDG 0.1K | A | A | A | A | A | A | A |
| | | VDG 10K | A | A | B | B | A | A | A |
| | | VDG 20K | A | B | B | B | A | B | B |
| | | VDG 30K | A | B | B | B | A | B | B |
| Contamination evaluation | | ΔC | 9.7 | 9.5 | 11.1 | 11.2 | 10 | 9.9 | 10.9 |

| | | | Example | | | | | |
|---|---|---|---|---|---|---|---|---|
| | | | 21 | 22 | 23 | 24 | 25 | 26 |
| Elastic layer | | | NBR | NBR | NBR | NBR | NBR | NBR |
| Particle | Particle No. | | 10 | 10 | 11 | 12 | 13 | 14 |
| | Graft portion | | Styrene acrylic | Styrene acrylic | Styrene acrylic | Styrene acrylic | Styrene acrylic | Styrene acrylic |
| | Butadiene | Parts | 25 | 25 | 25 | 25 | 25 | 25 |
| | Primary particle diameter | nm | 800 | 800 | 200 | 1000 | 50 | 1100 |
| | Circle-equivalent diameter | μm | 50 | 50 | 25 | 25 | 25 | 25 |
| | Average degree of unevenness | | 1.20 | 1.20 | 1.05 | 1.35 | 1.10 | 1.30 |
| | Content ratio in electro-conductive elastic layer | % by mass | 50 | 10 | 30 | 30 | 30 | 30 |
| Number of revolutions of polishing work | | rpm | 350 | 350 | 350 | 350 | 350 | 350 |

TABLE 11-continued

| | | | | | | | |
|---|---|---|---|---|---|---|---|
| Spark-out time in polishing process | sec | 1.0 | 1.0 | 1.0 | 1.0 | 1.0 | 1.0 |
| Average height of protrusion derived from crosslinked rubber particles on surface of charging member | nm | 200 | 200 | 200 | 200 | 200 | 200 |
| Image evaluation | VDG 0.1K | A | A | A | A | A | A |
| | VDG 10K | A | A | B | B | B | B |
| | VDG 20K | B | A | B | B | B | B |
| | VDG 30K | B | A | B | B | B | B |
| Contamination evaluation | ΔC | 12.0 | 10.5 | 14.3 | 14.1 | 15.1 | 16.1 |

TABLE 12

| | | Example | | | | | | |
|---|---|---|---|---|---|---|---|---|
| | | 27 | 28 | 29 | 30 | 31 | 32 | 33 |
| Elastic layer | | NBR | NBR | NBR | NBR | NBR | NBR | NBR |
| Particle | Particle No. | 15 | 16 | 16 | 16 | 16 | 17 | 17 |
| | Graft portion | Acrylic | Acrylic | Acrylic | Acrylic | Acrylic | Acrylic | Acrylic |
| Acrylic rubber | Parts | 25 | 25 | 25 | 25 | 25 | 25 | 25 |
| Primary particle diameter | nm | 400 | 300 | 300 | 300 | 300 | 700 | 700 |
| Circle-equivalent diameter | μm | 25 | 10 | 10 | 10 | 10 | 50 | 50 |
| Average degree of unevenness | | 1.20 | 1.20 | 1.20 | 1.20 | 1.20 | 1.20 | 1.20 |
| Content ratio in electro-conductive elastic layer | % by mass | 30 | 10 | 50 | 50 | 10 | 10 | 50 |
| Number of revolutions of polishing work | rpm | 350 | 350 | 350 | 350 | 350 | 350 | 350 |
| Spark-out time in polishing process | sec | 2.5 | 5.0 | 5.0 | 1.0 | 1.0 | 5.0 | 5.0 |
| Average height of protrusion derived from crosslinked rubber particles on surface of charging member | nm | 100 | 50 | 50 | 200 | 200 | 50 | 50 |
| Image evaluation | VDG 0.1K | A | A | A | A | A | A | A |
| | VDG 10K | A | A | B | B | A | A | A |
| | VDG 20K | A | B | B | B | A | B | B |
| | VDG 30K | A | B | B | B | A | B | B |
| Contamination evaluation | ΔC | 11.3 | 12 | 11.5 | 12.6 | 12.6 | 12.8 | 13.5 |

| | | Example | | | | | |
|---|---|---|---|---|---|---|---|
| | | 34 | 35 | 36 | 37 | 38 | 39 |
| Elastic layer | | NBR | NBR | NBR | NBR | NBR | NBR |
| Particle | Particle No. | 17 | 17 | 18 | 19 | 20 | 21 |
| | Graft portion | Acrylic | Acrylic | Acrylic | Acrylic | Acrylic | Acrylic |
| Acrylic rubber | Parts | 25 | 25 | 25 | 25 | 25 | 25 |
| Primary particle diameter | nm | 700 | 700 | 100 | 800 | 50 | 1100 |
| Circle-equivalent diameter | μm | 50 | 50 | 25 | 25 | 25 | 25 |
| Average degree of unevenness | | 1.20 | 1.20 | 1.05 | 1.35 | 1.10 | 1.30 |
| Content ratio in electro-conductive elastic layer | % by mass | 50 | 10 | 30 | 30 | 30 | 30 |
| Number of revolutions of polishing work | rpm | 350 | 350 | 350 | 350 | 350 | 350 |
| Spark-out time in polishing process | sec | 1.0 | 1.0 | 1.0 | 1.0 | 1.0 | 1.0 |
| Average height of protrusion derived from crosslinked rubber particles on surface of charging member | nm | 200 | 200 | 200 | 200 | 200 | 200 |

TABLE 12-continued

| | | | | | | | |
|---|---|---|---|---|---|---|---|
| Image evaluation | VDG 0.1K | A | A | A | A | A | A |
| | VDG 10K | A | A | B | B | B | B |
| | VDG 20K | B | A | B | B | B | B |
| | VDG 30K | B | A | B | B | B | B |
| Contamination evaluation | ΔC | 14.0 | 12.1 | 18.5 | 18.0 | 19.0 | 20.0 |

TABLE 13

| | | Example | | | | | | |
|---|---|---|---|---|---|---|---|---|
| | | 40 | 41 | 42 | 43 | 44 | 45 | 46 |
| Elastic layer | | NBR | NBR | NBR | NBR | NBR | NBR | NBR |
| Particle | Particle No. | 22 | 23 | 23 | 23 | 23 | 24 | 24 |
| | Graft portion | Styrene acrylic | Styrene acrylic | Styrene acrylic | Styrene acrylic | Styrene acrylic | Styrene acrylic | Styrene acrylic |
| Acrylic rubber | Parts | 25 | 25 | 25 | 25 | 25 | 25 | 25 |
| Primary particle diameter | nm | 400 | 300 | 300 | 300 | 300 | 700 | 700 |
| Circle-equivalent diameter | μm | 25 | 10 | 10 | 10 | 10 | 50 | 50 |
| Average degree of unevenness | | 1.20 | 1.20 | 1.20 | 1.20 | 1.20 | 1.20 | 1.20 |
| Content ratio in electro-conductive elastic layer | % by mass | 30 | 10 | 50 | 50 | 10 | 10 | 50 |
| Number of revolutions of polishing work | rpm | 350 | 350 | 350 | 350 | 350 | 350 | 350 |
| Spark-out time in polishing process | sec | 2.5 | 5.0 | 5.0 | 1.0 | 1.0 | 5.0 | 5.0 |
| Average height of protrusion derived from crosslinked rubber particles on surface of charging member | nm | 100 | 50 | 50 | 200 | 200 | 50 | 50 |
| Image evaluation | VDG 0.1K | A | A | A | A | A | A | A |
| | VDG 10K | A | A | B | B | A | A | A |
| | VDG 20K | A | B | B | B | A | B | B |
| | VDG 30K | A | B | B | B | A | B | B |
| Contamination evaluation | ΔC | 10.0 | 10.2 | 12.5 | 11.9 | 9.9 | 10.1 | 12.4 |

| | | Example | | | | | |
|---|---|---|---|---|---|---|---|
| | | 47 | 48 | 49 | 50 | 51 | 52 |
| Elastic layer | | NBR | NBR | NBR | NBR | NBR | NBR |
| Particle | Particle No. | 24 | 24 | 25 | 26 | 27 | 28 |
| | Graft portion | Styrene acrylic | Styrene acrylic | Styrene acrylic | Styrene acrylic | Styrene acrylic | Styrene acrylic |
| Acrylic rubber | Parts | 25 | 25 | 25 | 25 | 25 | 25 |
| Primary particle diameter | nm | 700 | 700 | 100 | 800 | 50 | 1100 |
| Circle-equivalent diameter | μm | 50 | 50 | 25 | 25 | 25 | 25 |
| Average degree of unevenness | | 1.20 | 1.20 | 1.05 | 1.35 | 1.10 | 1.30 |
| Content ratio in electro-conductive elastic layer | % by mass | 50 | 10 | 30 | 30 | 30 | 30 |
| Number of revolutions of polishing work | rpm | 350 | 350 | 350 | 350 | 350 | 350 |
| Spark-out time in polishing process | sec | 1.0 | 1.0 | 1.0 | 1.0 | 1.0 | 1.0 |
| Average height of protrusion derived from crosslinked rubber particles on surface of charging member | nm | 200 | 200 | 200 | 200 | 200 | 200 |
| Image evaluation | VDG 0.1K | A | A | A | A | A | A |
| | VDG 10K | A | A | B | B | B | B |
| | VDG 20K | B | A | B | B | B | B |
| | VDG 30K | B | A | B | B | B | B |
| Contamination evaluation | ΔC | 12.2 | 9.5 | 13.9 | 14.6 | 15.6 | 16.6 |

TABLE 14

| | | | Comparative Example | | | | | | | | |
|---|---|---|---|---|---|---|---|---|---|---|---|
| | | | 1 | 2 | 3 | 4 | 5 | 6 | 7 | 8 | 9 |
| Elastic layer | | | NBR | NBR | NBR | NBR | NBR | NBR | NBR | NBR | NBR |
| Particle | Particle No. | | — | 29 | 30 | 31 | 1 | 1 | 1 | 1 | 32 |
| | Graft portion | | — | None | Acrylic | Acrylic | Acrylic | Acrylic | Acrylic | Acrylic | Acrylic |
| | Butadiene | Parts | — | 25 | 25 | 25 | 25 | 25 | 25 | 25 | 25 |
| | Primary particle diameter | nm | — | 500 | 400 | 400 | 500 | 500 | 500 | 500 | — |
| | Circle-equivalent diameter | μm | — | 25 | 60 | 8 | 25 | 25 | 25 | 25 | 25 |
| | Average degree of unevenness | | | 1.20 | 1.20 | 1.20 | 1.20 | 1.20 | 1.20 | 1.20 | 1.20 |
| | Content ratio in electro-conductive elastic layer | % by mass | — | 30 | 30 | 30 | 30 | 30 | 8 | 51 | 30 |
| Number of revolutions of polishing work | | rpm | 350 | 350 | 350 | 350 | 350 | 350 | 350 | 350 | 350 |
| Spark-out time in polishing process | | sec | 0.0 | 2.5 | 0.0 | 5.0 | 0.0 | 10.0 | 2.5 | 2.5 | 2.5 |
| Average height of protrusion derived from particle on charging member surface | | nm | — | 100 | 250 | 50 | 250 | 30 | 100 | 100 | 100 |
| Image evaluation | | VDG 0.1K | A | A | A | A | A | A | A | A | A |
| | | VDG 10K | C | B | B | B | B | B | B | B | B |
| | | VDG 20K | D | C | C | C | C | C | C | C | C |
| | | VDG 30K | D | C | C | C | C | C | C | C | D |
| Contamination evaluation | | ΔC | 59.8 | 35.5 | 39.8 | 41.5 | 31.5 | 36.1 | 41.2 | 39.5 | 45.5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-193134, filed Sep. 30, 2015 which is hereby incorporated by reference herein in its entirety.

What is claimed is:

1. A charging member comprising:

an electro-conductive support; and an electro-conductive elastic layer on the electro-conductive support, wherein the electro-conductive elastic layer comprises 10% by mass or more and 50% by mass or less of an aggregate of crosslinked rubber particles, the aggregate of the crosslinked rubber particles has a circle-equivalent diameter of 10 μm or more and 50 μm or less, the crosslinked rubber particles have one of an acrylic resin and a styrene acrylic resin chemically bonded to a surface thereof, the charging member comprises protrusions derived from the aggregate of the crosslinked rubber particles on a surface thereof, and the protrusions have an average height of 50 nm or more and 200 nm or less.

2. The charging member according to claim 1, wherein the average height of the protrusion are 100 nm or more and 200 nm or less.

3. The charging member according to claim 1, wherein a primary particle diameter of the crosslinked rubber particles is 100 nm or more and 1000 nm or less.

4. The charging member according to claim 1, wherein a rubber of the crosslinked rubber particles is at least one selected from the group consisting of an acrylonitrile rubber and a styrene-butadiene rubber.

5. The charging member according to claim 1, wherein an average degree of unevenness of a surface of the aggregate of the crosslinked rubber particles is 1.10 or more and 1.30 or less.

6. An electrophotographic image forming apparatus comprising an electrophotographic photosensitive member and a charging member disposed in contact with the electrophotographic photosensitive member, wherein the charging member is a charging member comprising:

an electro-conductive support; and an electro-conductive elastic layer on the electro-conductive support, wherein the electro-conductive elastic layer comprises 10% by mass or more and 50% by mass or less of an aggregate of crosslinked rubber particles, the aggregate of the crosslinked rubber particles has a circle-equivalent diameter of 10 μm or more and 50 μm or less, the crosslinked rubber particles have one of an acrylic resin and a styrene acrylic resin chemically bonded to a surface thereof, the charging member comprises protrusions derived from the aggregate of the crosslinked rubber particles on a surface thereof, and the protrusions have an average height of 50 nm or more and 200 nm or less.

7. A process cartridge configured to be attachable to and detachable from a main body of an electrophotographic image forming apparatus, comprising an electrophotographic photosensitive member and a charging member disposed in contact with the electrophotographic photosensitive member, wherein the charging member is a charging member comprising:

an electro-conductive support; and an electro-conductive elastic layer on the electro-conductive support, wherein the electro-conductive elastic layer comprises 10% by mass or more and 50% by mass or less of an aggregate of a crosslinked rubber particles, the aggregate of the crosslinked rubber particles has a circle-equivalent diameter of 10 μm or more and 50 μm or less, the crosslinked rubber particles have one of an acrylic resin and a styrene acrylic resin chemically bonded to a surface thereof, the charging member comprises protrusions derived from the aggregate of the crosslinked rubber particles on a surface thereof, and the protrusions have an average height of 50 nm or more and 200 nm or less.

* * * * *